US010473109B2

(12) United States Patent
Gallinelli et al.

(10) Patent No.: US 10,473,109 B2
(45) Date of Patent: Nov. 12, 2019

(54) METHOD AND SYSTEM FOR OPERATING A BACK-TO-BACK COMPRESSOR WITH A SIDE STREAM

(71) Applicant: Nuovo Pignone Srl, Florence (IT)

(72) Inventors: Lorenzo Gallinelli, Florence (IT); David Rossi, Florence (IT); Laurence Casali, Florence (IT)

(73) Assignee: Nuovo Pignone Srl, Florence (IT)

( * ) Notice: Subject to any disclaimer, the term of this patent is extended or adjusted under 35 U.S.C. 154(b) by 341 days.

(21) Appl. No.: 15/122,971

(22) PCT Filed: Mar. 2, 2015

(86) PCT No.: PCT/EP2015/054289
§ 371 (c)(1),
(2) Date: Sep. 1, 2016

(87) PCT Pub. No.: WO2015/132196
PCT Pub. Date: Sep. 11, 2015

(65) Prior Publication Data

US 2017/0074274 A1 Mar. 16, 2017

(30) Foreign Application Priority Data

Mar. 3, 2014 (IT) ..... FI2014A0044

(51) Int. Cl.
*F04D 27/02* (2006.01)
*F04D 17/12* (2006.01)
*F04D 27/00* (2006.01)

(52) U.S. Cl.
CPC ..... *F04D 27/0215* (2013.01); *F04D 17/12* (2013.01); *F04D 27/001* (2013.01); *F04D 27/02* (2013.01); *F04D 27/0269* (2013.01)

(58) Field of Classification Search
CPC .... F04D 27/0215; F04D 17/12; F04D 27/001; F04D 27/02; F04D 27/0269; F04D 17/10; F04D 27/005
(Continued)

(56) References Cited

U.S. PATENT DOCUMENTS 4,203,701 A 5/1980 Abbey
6,503,048 B1 * 1/2003 Mirsky ..... F01D 21/12 415/1
(Continued)

FOREIGN PATENT DOCUMENTS

CN 2856509 Y 1/2007
CN 101253331 A 8/2008
(Continued)

OTHER PUBLICATIONS

Almasi, Amin, The Complicated Case of Compressors with Side Streams, Dec. 31, 2014, Flow Control Network.*
(Continued)

*Primary Examiner* — Kayla Mccaffrey
(74) *Attorney, Agent, or Firm* — Baker Hughes Patent Organization

(57) ABSTRACT

The compressor system comprises a compressor having first compressor stage and a second compressor stage in a back-to-back arrangement. A first gas flow is provided at the suction side of the compressor. A seal arrangement is provided between the first compressor stage and the second compressor stage. A side stream line is in fluid communication with the suction side of the second compressor stage. A side stream valve on the side stream line and a side stream controller are provided, for adjusting the flow of the second gas. An antisurge arrangement comprised of a bypass line and an antisurge valve is arranged at the first compressor stage for preventing surge of the first compressor stage. The
(Continued)

side stream controller is configured for reducing the flow of the second gas when an alteration of the pressure ratio across the first compress stag is detected.

14 Claims, 3 Drawing Sheets

(58) Field of Classification Search
USPC ..... 415/1, 28
See application file for complete search history.

(56) References Cited

U.S. PATENT DOCUMENTS

| | | | | |
|---|---|---|---|---|
| 2007/0186770 | A1* | 8/2007 | Heath | B01D 53/1487 95/179 |
| 2009/0320370 | A1* | 12/2009 | Fecteau | C01B 3/38 48/199 R |

FOREIGN PATENT DOCUMENTS

| | | | |
|---|---|---|---|
| CN | 201170187 | Y | 12/2008 |
| CN | 101501342 | A | 8/2009 |
| EP | 0226039 | A1 | 6/1987 |
| RU | 2 458 253 | C1 | 8/2012 |
| RU | 2 461 738 | C1 | 9/2012 |
| WO | 20100084422 | A2 | 7/2010 |

OTHER PUBLICATIONS

International Search Report and Written Opinion dated Mar. 26, 2015 which was issued in connection with PCT Patent Application No. PCT/EP2015/054289 which was filed on Mar. 2, 2015.
Italian Search Report and Written Opinion dated Nov. 4, 2014 which was issued in connection with Italian Patent Application No. FI2014A000044 which was filed on Mar. 3, 2014.
First Office Action and Search issued in connection with corresponding CN Application No. 201580012030.7 dated Apr. 3, 2018.
Decision to Grant issued in connection with corresponding RU Application No. 2016133686 dated Aug. 2, 2018.

* cited by examiner

METHOD AND SYSTEM FOR OPERATING A BACK-TO-BACK COMPRESSOR WITH A SIDE STREAM

FIELD OF THE INVENTION

The present disclosure relates to compressors, and more specifically to so-called back-to-back compressors having a side stream between a first compressor stage and a second compressor stage arranged in a back-to-back configuration.

BACKGROUND

Centrifugal compressors are used in a wide variety of industrial applications. For instance, centrifugal compressors are used in the oil and gas industry, for boosting the pressure of hydrocarbon gases. The compression work required for compressing gas through the rotating impellers and the diffusers of a centrifugal compressor generates an axial thrust on the compressor shaft. Balancing drums are often used for reducing the total axial thrust on the shaft bearings.

Some known compressors have a so-called back-to-back configuration, which reduces the axial thrust on the compressor shaft. The delivery side of the first compressor stage faces the delivery side of the second compressor stage, so that the processed gas flows through the first compressor stage generally in one direction and through the second compressor stage in the generally opposite direction. A main stream of gas processed by the compressor is sucked at the suction side of the first compressor stage and delivered at the delivery side of the second compressor stage.

In some applications, a side stream line is provided to inject a side stream gas between the delivery side of the first compressor stage and the suction side of the second compressor stage. In some applications, the side stream gas has a chemical composition different from the chemical composition of the gas sucked in the first compressor stage. For instance, the first gas processed by the first compressor stage has a molecular weight higher than the molecular weight of the side stream gas. The gas flowing through the second compressor stage, which is a mixture of the gas from the first compressor stage and the side stream gas, thus has a mean molecular weight lower than the gas flowing through the first compressor stage.

A seal arrangement is provided on the compressor shaft, between the first compressor stage and the second compressor stage, so as to reduce backflow from the last impeller at the delivery side in the second compressor stage towards the last impeller in the first compressor stage. The seal efficiency is usually such that approximately between 10-20% by weight of the gas delivered by the last impeller in the second compressor stage flows back towards the last impeller in the first compressor stage.

The first compressor stage is provided with an antisurge arrangement, usually including a recirculating bypass line including an anti-surge valve. The bypass line connects the delivery side to the suction side of the first compressor stage. When the operating point of the first compressor stage approaches the antisurge limit line, the antisurge valve is opened and a fraction of the gas flow delivered at the delivery side of the first compressor stage is recirculated towards the suction side of the first compressor stage.

When the antisurge valve opens, the gas from the side stream which leaks through the sealing arrangement between first and second compressor stages is recirculated at the suction side of the first compressor stage. As a consequence of the antisurge gas recirculation, low molecular weight gas accumulates in the first compressor stage. The mean molecular weight of the gas processed by the first compressor stage thus decreases. Since the pressure ratio of a compressor stage is dependent upon the molecular weight of the processed gas and drops when the molecular weight diminishes, antisurge recirculation causes a drop in the pressure ratio across the first compressor stage. This can eventually result in the gas pressure at the first stage suction header to increase. In some arrangements, the pressure of the gas delivered at the suction header is limited, and cannot increase at will. In this case, a drop of the pressure ratio and consequent increase of the pressure at the compressor suction side will reduce the gas flow delivered through the suction header. Under some circumstances this situation can finally lead to a loss of gas flow through the compressor train. This situation is particularly critical when two or more compressor trains are arranged in parallel and supplied by the same gas source. As a matter of fact, in this case a pressure increase at the suction side of one compressor will result in an unbalanced gas flow, with decreasing flow rate through the compressor where the pressure ratio has dropped, and increasing flow rate through the other paralleled compressor(s).

A need therefore exists for alleviating the risk of malfunctioning of a back-to-back compressor arrangement with a low molecular weight side stream.

BRIEF DESCRIPTION

According to a first aspect, the subject matter disclosed herein relates to a method for operating a gas compressor including a first compressor stage and a second compressor stage in a back-to-back arrangement, the first compressor stage arranged upstream of the second compressor stage with respect to the direction of gas processed by the compressor; a seal arrangement between the first compressor stage and the second compressor stage; and a side stream line between the first compressor stage and the second compressor stage. According to some embodiments, the method provides for feeding a first gas having a first molecular weight to a suction side of the first compressor stage and compressing the first gas through the first compressor stage. The method further provides feeding a side stream flow of a second gas through the side stream line to the second compressor stage, the second gas having a molecular weight lower than the first gas. The gas mixture formed by the first and second gas is compressed through the second compressor stage. To prevent or reduce a pressure ratio drop across the first compressor stage due to recirculation of the gas mixture, e.g. when an antisurge bypass line is opened, the side-stream gas flow is reduced. This increases the pressure ratio across the second compressor stage and thus counter-acts the reduction of pressure ratio across the first compressor stage.

The method is based on the recognition that recirculation of gas for antisurge purposes in a system where the side stream gas has a molecular weight lower than the gas entering the first, upstream compressor stage, causes a reduction of the molecular weight of the gas processed by the first compressor stage. Such alteration of the molecular weight reduces the pressure ratio across the first compressor stage. To contrast or compensate for the drop of the pressure ratio, the molecular weight of the gas processed though the second compressor stage is increased by reducing the flow rate through the side stream line.

According to a further aspect, the subject matter disclosed herein relates to a first compressor stage and a second compressor stage arranged back-to back with a seal arrangement therebetween. The system further includes a side stream line in fluid communication with the suction side of the second compressor stage, for delivering a side stream gas flow having a molecular weight lower than the molecular weight of a main gas flow delivered at the suction side of the first compressor stage. A side stream valve and a side stream controller are further provided for adjusting the flow of the second gas through the side stream line. An antisurge arrangement including a bypass line and an antisurge valve is combined with the first compressor stage. The antisurge valve is opened, if required, for recirculating a portion of the gas flow processed by the first compressor stage, in order to prevent surging phenomena in the first compressor stage. A transducer arrangement is additionally provided for detecting at least one pressure parameter of the first compressor stage, e.g. the pressure ratio and/or the suction pressure. The side stream controller is configured for reducing the flow of gas through the side stream when the pressure transducer arrangement detects an alteration of the pressure parameter indicative of a reduction of a pressure ratio across the first compressor stage provoked by a recirculation of gas through the antisurge arrangement.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
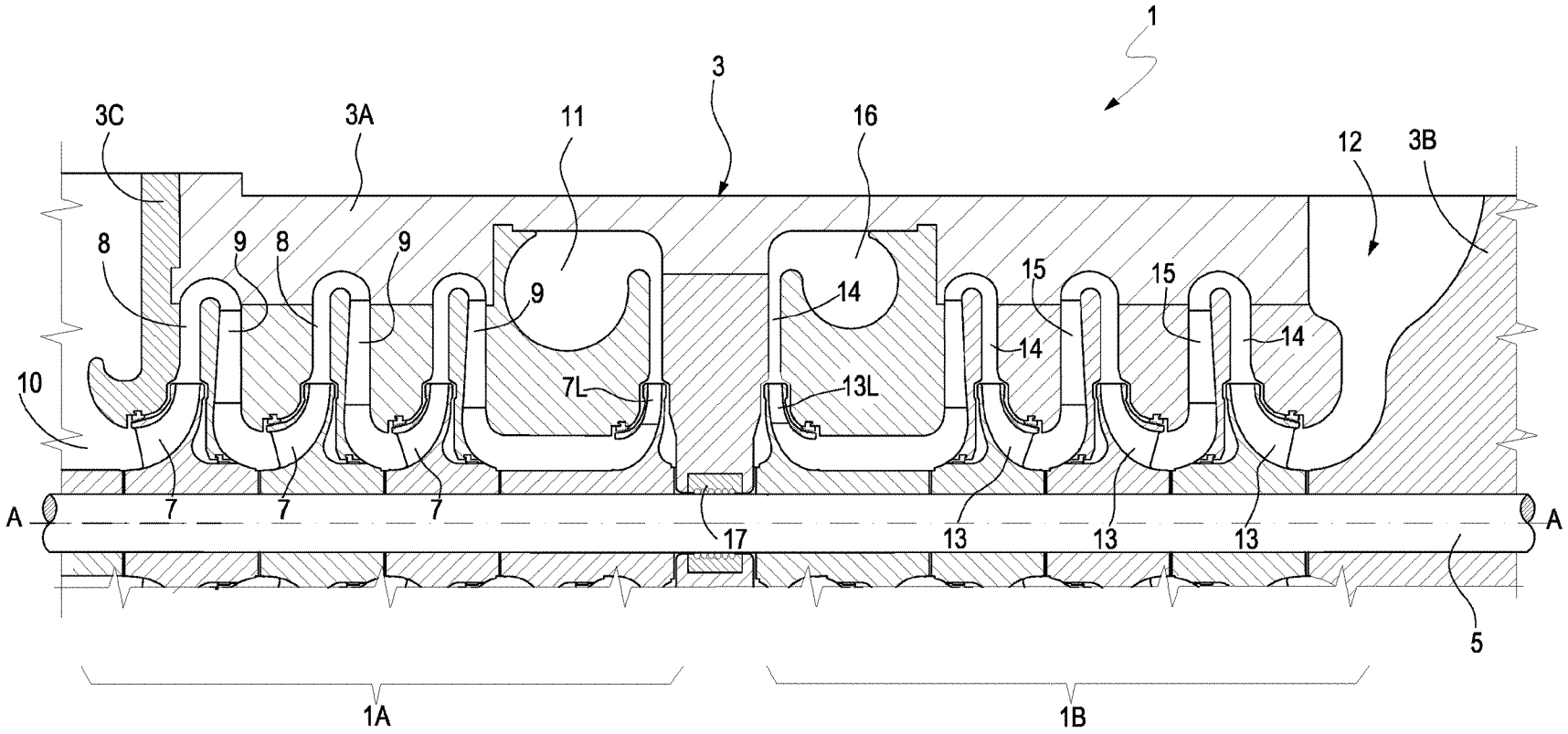
FIG. 1 illustrates a cross sectional view of a back-to-back compressor according to a plane containing the rotation axis of the compressor rotor.

FIG. 1 schematically illustrates a cross section of a back-to-back compressor 1 according to a plane containing the rotation axis AA of the compressor rotor. The compressor 1 includes a casing 3 and a shaft 5 arranged for rotation in the casing 3.

The compressor 1 can be a vertically split compressor with a barrel 3A and two head end covers 3B, 3C. In other embodiments, not shown, the compressor can be a horizontally split compressor with a casing including two halves matching along a substantially horizontal plane containing the rotation axis of the compressor shaft.

In the embodiment shown in FIG. 1, the compressor 1 includes a first compressor stage 1A and a second compressor stage 1B arranged back-to-back. The first compressor stage 1B includes one or more impellers 7 mounted on shaft 5 for rotation around axis A-A. A plurality of diffusers 8 and return channels 9 formed in a compressor diaphragm define a first compression path for a gas entering the first compressor stage 1A at a suction side 10 and exiting at a delivery side 11.

The suction side 10 can include a gas inlet plenum in fluid communication with the first impeller 7. The delivery side 11 can include a volute, wherefrom the gas is collected and further conveyed through connecting ducts (not shown in FIG. 1) to a suction side 12 of the second compressor stage 1B.

According to some embodiments, the second compressor stage 1B includes one or more impellers 13 mounted on shaft 5 for rotation around rotation axis A-A. The second compressor stage further includes diffusers 14 and return channels 15 formed in a compressor diaphragm and defining a second compression path for the gas processed by the second compressor stage 1B.

The gas enters the second compressor stage 1B at the inlet or suction side 12 and is sequentially processed through the impellers, diffusers and return channels of the second compressor stage 1B. Compressed gas is finally delivered at a delivery side 16 of the second compressor stage 1B, which also represents the delivery side of compressor 1. The delivery side 16 of compressor 1 can include a volute which collects the gas from the diffuser of the last impeller and conveys the compressed gas towards an outlet duct, not shown.

Between the last impeller 7L of the first compressor stage 1A and the last impeller 13L of the second compressor stage 113 a sealing arrangement 17 is provided around the compressor shaft 5. The sealing arrangement 17 reduces leakages along the shaft 5 from the last impeller 13L of the second compressor stage 1B, where the gas has achieved a higher pressure, towards the last impeller 7L of the first compressor stage 1A, where the gas is at a lower pressure. The sealing arrangement can be comprised of a labyrinth seal, for instance.

In spite of the sealing arrangement, during compressor operation a leakage of between 10-20%, typically between around 15% and 18% by weight flows from the second compressor stage 1B towards the first compressor stage 1A and is returned at the suction side 12 of the second compressor stage 1B.

Figure 2:
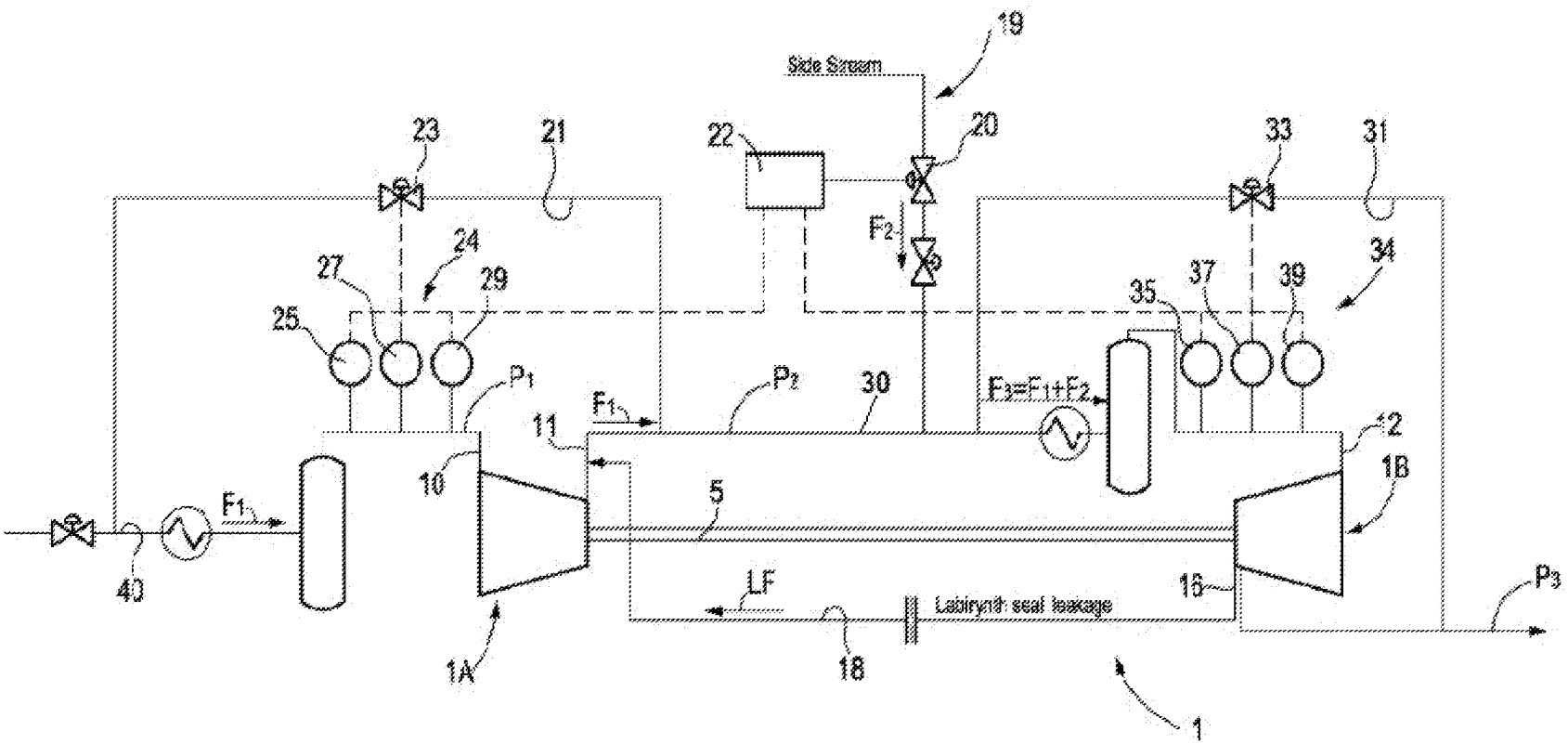
FIG. 2 illustrates a schematic of the compressor and relevant antisurge systems.

FIG. 2 is a schematic of the compressor 1 and relevant gas connections. In FIG. 2 the gas leakage through the sealing arrangement 17 is schematically shown at 18. Reference number 30 schematically represents the duct which connects the delivery side 11 of the first compressor stage 1A to the suction side 12 of the second compressor stage 1B. Reference number 40 indicates the suction header of the first compressor stage 1A.

As best shown in FIG. 2, with continuing reference to FIG. 1, a side stream line 19 delivers a side stream gas flow between the delivery side 11 of the first compressor stage 1A and the suction side of the second compressor stage 1B. A side stream valve 20 can be provided on the side stream line 19. Reference number 22 schematically denotes a side-stream controller for controlling the side-stream valve 20, as will be described further below. The side stream line is schematically shown as being connected to duct 30. According to some embodiments, the side stream line 19 can be in fluid communication with the inlet of the second compressor stage 1B through side stream nozzles, which can deliver the side stream flow directly at the inlet of the first, i.e. most upstream impeller 13 of the second compressor stage 1B.

In the schematic of FIG. 2, P1 denotes the suction side pressure at the suction side of the first compressor stage 1A, i.e. the suction pressure of compressor 1. P2 denotes the delivery pressure at the delivery side 16 of the second compressor stage 1B, i.e. the delivery pressure of compressor 1. Reference P2 denotes the suction pressure of the second compressor stage 1B, i.e. the inter-stage pressure. For the sake of the following description, it is assumed that the delivery pressure P3 at the delivery side of compressor 1 is to be maintained constant.

Reference number 21 denotes a bypass line of an antisurge arrangement for the first compressor stage 1A. Reference number 23 denotes a respective antisurge valve arranged on bypass line 21. A transducer arrangement 24 can be provided at the compressor inlet. In some embodiments the transducer arrangement 24 can include a pressure transducer 25, which detects the gas pressure at the suction side of the compressor 1, i.e. at the suction side of first compressor stage 1A. The transducer arrangement 24 can further include a flow transducer 27 to detect the gas flow rate at the suction side of compressor 1. According to some embodiments, the transducer arrangement 24 can include a temperature transducer 29, which detects the gas flow temperature at the suction side of compressor 1. In general terms, the transducer arrangement 24 is comprised of those instrumentalities which are required by the anti surge control used for the specific compressor stage 1A.

The second compressor stage 1B can be provided with a separate antisurge arrangement. Referring again to FIG. 2, reference number 31 denotes a bypass line of the antisurge arrangement for the second compressor stage 1B. Reference number 33 denotes a respective antisurge valve arranged on bypass line 31. A transducer arrangement 34 can be provide at the inlet or suction side 12 of the second compressor stage 1B. In some embodiments the transducer arrangement 34 can include a pressure transducer 35, which detects the gas pressure at the suction side of the second compressor stage 1A. The transducer arrangement 34 can further be comprised of a flow transducer 37 to detect the gas flow rate at the suction side of the second compressor stage 1B. According to some embodiments, the transducer arrangement 34 can include a temperature transducer 39, which detects the gas flow temperature at the suction side of the second compressor stage 1B. In general terms, the transducer arrangement 34 is comprised of those instrumentalities which are required by the antisurge control used for the specific compressor stage 1B.

The antisurge systems can operate according to any available antisurge algorithm known to those skilled in the art of compressor control. The details of the antisurge algorithms need not be described herein. Suffice it to recall that the antisurge valve will open when the operating point of the compressor stage approaches the surge limit line, preventing surge phenomena to arise in the compressor stage. Antisurge recirculation of the gas flow through the bypass line 21 or 31 is required when the gas flow ingested at the suction side of the compressor stage is insufficient to maintain the compressor stage in stable operation conditions.

During operation, a first or main gas flow F1 is delivered to the suction side 10 of the first compressor stage 1A and is processed through the first compressor stage 1A. The gas of the first gas flow has a first molecular weight MW1. The gas composition can be constant or variable during operation of the compressor. For the sake of the present disclosure, the molecular weight MW1 is assumed to be constant or quasi-constant.

A second gas flow F2 is delivered as a side-stream gas flow along the side stream line 19 at the suction side 12 of the second compressor stage 1B. The gas delivered through the side stream line 19 has a second molecular weight MW2, lower than the first molecular weight MW1. For the sake of the present disclosure, the second molecular weight MW2 is assumed to be constant during operation.

The side-stream gas flow F2 mixes with the main gas flow F1 delivered from the delivery side 11 of the first compressor stage 1A. The gas mixture F3 of the first gas flow F1 and second gas flow F2 is processed through the second compressor stage 1B. The mean molecular weight MW3 of the gas processed through the second compressor stage 1B is lower than the molecular weight MW1 of the first gas processed by the first compressor stage 1A, due to the contribution of the side stream gas having a molecular weight MW2 lower than MW1.

During normal operation, a leakage flow LF due to the pressure drop across the sealing arrangement 17 flows form the delivery side 16 of the second compressor stage 1B towards the delivery side 11 of the first compressor stage 1A. Even though the leakage flow LF has a molecular weight MW3 lower than the first gas flow F1, the leakage flow LF does not affect the operating conditions of the first compressor stage 1A, since the leakage flow LF is not processed through the first compressor stage, but is rather directly returned to the inlet 12 of the second compressor stage 1B.

When the first compressor stage 1A operates far from the surge limit line, the antisurge valve 23 is closed. However, if the operating point of the first compressor stage 1A approaches the surge limit line, schematically represented at SL in the flow-vs-pressure ratio (flow/head) diagram of FIG. 3, the antisurge valve 23 will open to recirculate part of the gas flow processed through the first compressor stage 1A, so as to increase the flow rate through the first compressor stage 1A. Since the gas at the delivery side 11 of compressor stage 1A contains a portion of the second gas at lower molecular weight MW2, recirculation through the bypass line 21 causes a reduction of the molecular weight MW1 of the gas processed through the first compressor stage 1A.

Figure 3:
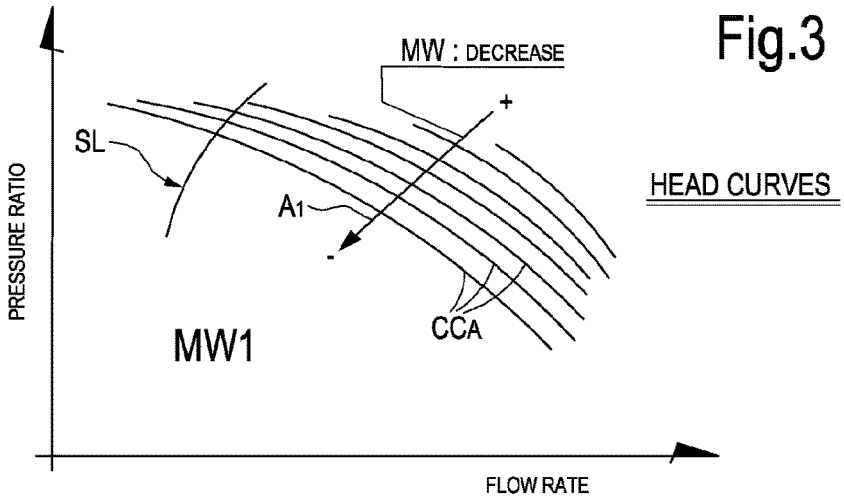
FIGS. 3 and 4 illustrate two flow rate-vs pressure ratio diagrams for the first and second compressor stages of the compressor of FIGS. 1 and 2.

The pressure ratio of both compressor stages 1A, 1B is dependent upon the molecular weight of the processed gas. More specifically, the pressure ratio decreases when the molecular weight decreases, and vice-versa. FIG. 3 illustrates a plurality of characteristic curves $CC_A$ of the first compressor stage 1A for different values of the molecular weight MW1 of the gas processed by the compressor stage. Arrow A1 in FIG. 3 indicates the direction of decreasing molecular weight. It can be appreciated that for a given flow rate a decrease of gas molecular weight causes a corresponding reduction of the pressure ratio, and vice-versa.

The pressure ratio across the first compressor stage 1A thus provides an indirect measure of the mean molecular weight MW1 of the gas processed through the first compressor stage 1A, When the antisurge control opens the anti surge valve 23, the pressure ratio across the first compressor stage 1A, or more generally a pressure parameter related thereto, e.g. the suction side pressure P3, will provide an indirect indication of an alteration of the molecular weight of the gas processed by the first compressor stage 1A, due to recirculation of a fraction of low-molecular weight gas from the anti surge bypass line 12.

According to some embodiments, a drop in the pressure ratio can be detected by the pressure transducers 25, 35 at the suction side 10 of the first compressor stage 1A and at the suction side of the second compressor stage 1B. The pressure ratio P2/P1 can be used as a pressure parameter of the first compressor stage, which provides indirect evidence of an alteration of the molecular weight of the gas being processed through the first compressor stage 1A.

According to other embodiments, the pressure P1 at the suction side 10 of the first compressor stage 1A can be used as a parameter to determine if the molecular weight of the gas is changing. For instance, if the pressure P3 at the delivery of compressor 1 is fixed, a drop of the molecular weight MW1 will cause an increase of the suction pressure P1, as the delivery pressure P3 and the inter-stage pressure P2 remaining constant.

If the pressure P1 at the suction header 40 increases due to the reduction of molecular weight of the gas processed by compressor stage 1A, the flow rate through the compressor 1 will also drop until finally the upstream process supplying the gas to the suction header 40 of the first compressor stage 1A will not be capable of delivering gas flow towards the compressor. Finally, the gas flow through compressor 1 will stop.

To prevent final collapse of the gas flow through the compressor 1, if an increase of the suction pressure P1 is detected, or else if a reduction of the pressure ratio P2/P1 is detected, the side-stream controller 22 acts upon the side-stream valve 20 to reduce the side-stream flow. Upon reduction of the side-stream flow, the mean molecular weight MW3 of the gas processed by the second compressor stage 1B increases, since the percentage of low molecular weight gas from the side stream line 19 reduces.

This in turn results in an increased pressure ratio P3/P2. If the delivery pressure P3 is constant, the suction pressure P2 of the second compressor stage 1B and consequently the suction pressure P1 of the first compressor stage 1A will drop as a consequence of the increase of molecular weight of the gas flow F3 processed by the second compressor stage 1B.

In some embodiments, the side stream flow control based on variations of the suction pressure P1 at the suction side 10 of compressor stage 1A is enabled only if the antisurge control of the first compressor stage 1A is active, i.e. if the antisurge valve 23 is at least partly open, and/or if the first compressor stage 1A is approaching the surge line SL. This prevents reduction of side stream flow in case of a drop of the pressure ratio P2/P1 due e.g. to the operating point of compressor stage 1A moving towards the right side of the head/flow chart (FIG. 3). Indeed, a reduction of the pressure ratio P3/P2 could also be caused by increasing flow rate through the compressor 1. In this case, the detected alteration of the pressure parameter is not due to a variation of the molecular weight of the gas being processed through the first compressor stage 1A and the side stream control should not be acted upon.

Figure 4:
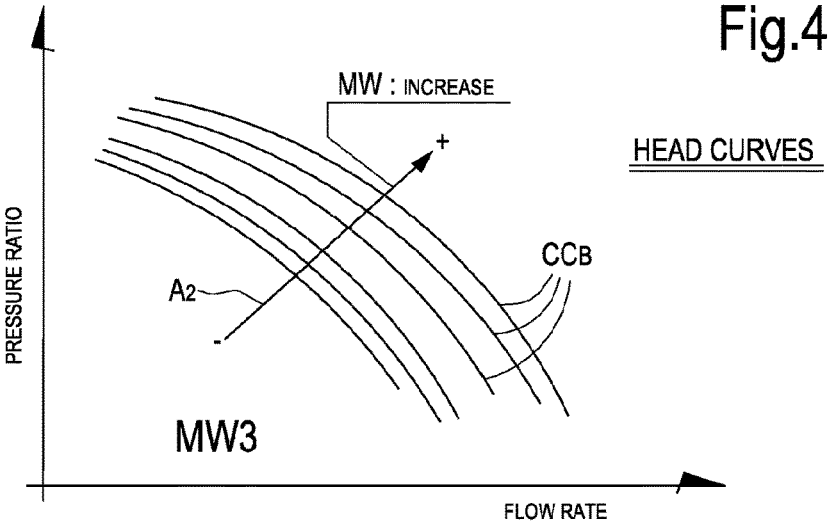

The control of the pressure ratio via adjustment of the side-stream flow rate can be best appreciated looking at FIG. 4, which illustrates a flow-vs.-pressure ratio diagram for the second compressor stage 1B. FIG. 4 illustrates a plurality of characteristic curves $CC_B$ of the second compressor stage 1B for different values of the molecular weight MW3 of the gas processed by the compressor stage. Arrow A2 in FIG. 3 indicates the direction of increasing molecular weight. FIG. 4 shows that for a given flow rate, by increasing the gas molecular weight MW3, the pressure ratio also increases.

The side-stream flow rate can thus be adjusted until the suction pressure P1 of the compressor stage 1A reaches a set point, preventing collapse of the flow through compressor 1.

Figure 5:
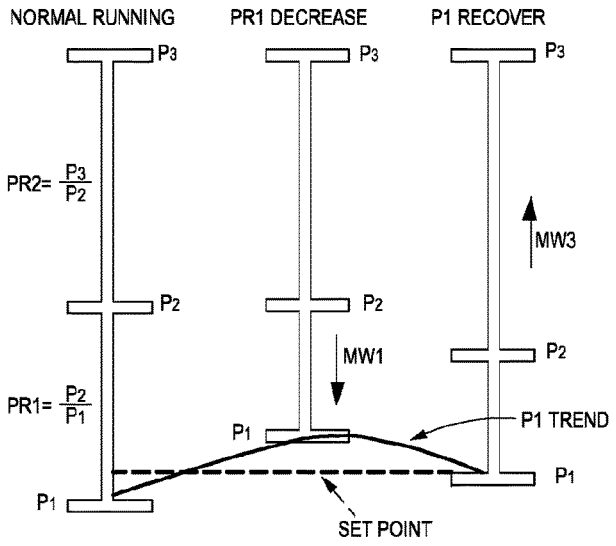
FIG. 5 illustrates a diagram showing the pressure control.

FIG. 5 graphically illustrates the above described control process. The left side diagram illustrates the pressure values and the pressure ratios across the first compressor stage (PR1=P2/P1) and across the second compressor stage (PR2=P3/P2) under normal operating conditions (antisurge inactive). The central diagram illustrates the behavior of the pressure ratios and of the pressure values caused by a decrease of the molecular weight MW1 of the gas flowing through the first compressor stage 1A. The third diagram illustrates the pressure adjustment obtained by increasing the molecular weight MW3 of the gas processed by the second compressor stage 1B by reducing the side flow rate. The suction side pressure P1 drops gradually again towards the set point value.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. Different features, structures and instrumentalities of the various embodiments can be differently combined.

The invention claimed is:

1. A method for operating a gas compressor comprising a first compressor stage and a second compressor stage in a back-to-back arrangement, a seal arrangement between the first compressor stage and the second compressor stage, and a side stream line between the first compressor stage and the second compressor stage, the method comprising:

feeding a first gas having a first molecular weight to a suction side of the first compressor stage and compressing the first gas through the first compressor stage;

feeding a side stream flow of a second gas through the side stream line to the second compressor stage, the second gas having a molecular weight lower than the first gas;

compressing a gas mixture of the first and second gas through the second compressor stage;

detecting a pressure parameter of the first compressor stage;

providing an antisurge system for the first compressor stage, comprised of a bypass line and an antisurge valve; and regulating the side stream flow only if the antisurge system is active to correct a pressure ratio alteration across the compressor caused by a variation of molecular weight of the gas compressed by the first compressor stage provoked by a recirculation of the gas mixture from the second compressor stage to the first compressor stage.

2. The method of claim 1, wherein the pressure parameter is a pressure ratio across the first compressor stage.

3. The method of claim 1, wherein the pressure parameter is a suction pressure at the suction side of the first compressor stage.

4. A method for operating a gas compressor, the method comprising:

providing a first compressor stage and a second compressor stage in a back-to-back arrangement;

providing a seal arrangement between the first compressor stage and the second compressor stage;

providing a side stream line between the first compressor stage and the second compressor stage;

providing an antisurge system for the first compressor stage, comprised of a bypass line and an antisurge valve;

feeding a first gas having a first molecular weight to a suction side of the first compressor stage and compressing the first gas through the first compressor stage;

feeding a side stream flow of a second gas through the side stream line, the second gas having a molecular weight lower than the molecular weight of the first gas;

compressing a gas mixture of the first and second gas through the second compressor stage;

recirculating gas mixture from the second compressor stage to the suction side of the first compressor stage; and regulating the side stream flow only if the antisurge system is active to correct a pressure ratio alteration across the compressor caused by a variation of molecular weight of the gas processed by the first compressor stage provoked by recirculated gas mixture.

5. The method of claim 4, wherein the side stream flow is reduced when a reduction of the pressure ratio across the first compressor stage is detected.

6. The method of claim 4, wherein the side stream flow is reduced when an increase of a suction pressure at the suction side of the first compressor stage is detected.

7. A compressor system comprising:

a compressor comprised of:

a first compressor stage having a suction side and a delivery side, the suction side configured to receive a flow of a first gas having a molecular weight;

a second compressor stage, having a suction side and a delivery side, the first compressor stage and the second compressor stage arranged in a back-to-back arrangement; and a seal arrangement between the first compressor stage and the second compressor stage;

a side stream line in fluid communication with the suction side of the second compressor stage, configured to deliver a flow of a second gas having a molecular weight lower than the first gas, a mixture flow of the first gas and second gas being processed through the second compressor stage;

a side stream valve on the side stream line configured to adjust the flow of the second gas;

a side stream controller configured to control the side stream valve;

an antisurge arrangement comprised of: a bypass line configured to recirculate gas from the delivery side to the suction side of the first compressor stage and an antisurge valve on the bypass line; and a pressure transducer arrangement configured to detect at least one pressure parameter of the first compressor stage, wherein the side stream controller is configured to reduce the flow of the second gas when the pressure transducer arrangement detects an alteration of said pressure parameter indicative of a reduction of a pressure ratio across the first compressor stage provoked by a recirculation of gas through the antisurge arrangement, and enable reduction of the side stream flow if the antisurge arrangement is active or if the first compressor stage is operating near a surge limit line.

8. The system of claim 7, wherein the pressure transducer arrangement is configured to detect a variation of a pressure of the gas at the suction side of the first compressor stage.

9. The system of claim 8, wherein the side stream controller is configured to cause a reduction of the side stream flow when a reduction of the pressure ratio across the first compressor stage is detected.

10. The system of claim 7, wherein the pressure transducer arrangement is configured to detect variation of a pressure ratio across the first compressor stage.

11. The system of claim 10, wherein the side stream controller is configured to cause a reduction of the side stream flow when a reduction of the pressure ratio across the first compressor stage is detected.

12. The system of claim 7, wherein the side stream controller is configured to cause a reduction of the side stream flow when a reduction of the pressure ratio across the first compressor stage is detected.

13. The system of claim 7, wherein the side stream controller is configured to cause a reduction of the side stream flow when an increase in a gas pressure at the suction side of the first compressor stage is detected.

14. A method for operating a gas compressor comprising a first compressor stage and a second compressor stage in a back-to-back arrangement, a seal arrangement between the first compressor stage and the second compressor stage, and a side stream line between the first compressor stage and the second compressor stage, the method comprising:

feeding a first gas having a first molecular weight to a suction side of the first compressor stage and compressing the first gas through the first compressor stage;

feeding a side stream flow of a second gas through the side stream line to the second compressor stage, the second gas having a molecular weight lower than the first gas;

compressing a gas mixture of the first and second gas through the second compressor stage;

detecting a pressure parameter of the first compressor stage, wherein the pressure parameter is a pressure ratio across the first compressor stage or a suction pressure at the suction side of the first compressor stage;

providing an antisurge system for the first compressor stage, comprised of a bypass line and an antisurge valve; and regulating the side stream flow only if the antisurge system is active to correct a pressure ratio alteration across the compressor caused by a variation of molecular weight of the gas compressed by the first compressor stage provoked by a recirculation of the gas mixture from the second compressor stage to the first compressor stage.

* * * * *